US012788117B2

(12) United States Patent
Poulakis et al.

(10) Patent No.: US 12,788,117 B2
(45) Date of Patent: Nov. 10, 2026

(54) METHOD FOR PRODUCING A TOUCH-AND-CLOSE FASTENER PART

(71) Applicant: Gottlieb Binder GmbH & Co. KG, Holzgerlingen (DE)

(72) Inventors: Konstantinos Poulakis, Hildrizhausen (DE); Lars Heepe, Tuebingen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 225 days.

(21) Appl. No.: 18/545,169

(22) Filed: Dec. 19, 2023

(65) Prior Publication Data

US 2024/0115013 A1 Apr. 11, 2024

Related U.S. Application Data

(63) Continuation of application No. PCT/EP2022/064913, filed on Jun. 1, 2022.

(30) Foreign Application Priority Data

Jun. 26, 2021 (DE) ..... 10 2021 003 311.6

(51) Int. Cl.
*A44B 18/00* (2006.01)

(52) U.S. Cl.
CPC ..... *A44B 18/0038* (2013.01); *A44B 18/0026* (2013.01); *Y10T 428/24017* (2015.01)

(58) Field of Classification Search
CPC ..... A44B 18/0026; A44B 18/0038
See application file for complete search history.

(56) References Cited

U.S. PATENT DOCUMENTS 3,138,841 A 6/1964 Naimer
3,673,301 A * 6/1972 Billarant ..... A44B 18/0015 26/9
3,770,359 A * 11/1973 Hamano ..... D06C 13/08 425/305.1
7,351,464 B2 4/2008 Poulakis
(Continued)

FOREIGN PATENT DOCUMENTS

DE 100 61 952 A1 6/2002
DE 102 40 986 B3 2/2004
(Continued)

OTHER PUBLICATIONS

Translation of JP-H0741363-Y2 (Year: 1995).*

*Primary Examiner* — John J DeRusso
(74) *Attorney, Agent, or Firm* — Orbit IP, LLP; Marc G. Martino

(57) ABSTRACT

A method for producing a touch-and-close fastener part includes producing a base structure from a thread system having individual loops which are at least partially of a polyamide or polyester plastics material. At least a portion of the loops are cut to form two stem-like loop ends. The loop ends are heated at a predeterminable temperature and for a predeterminable heating time until a head shape is produced as a thickening at the respective loop end under the surface tension of the plastics material. The head shape is formed with a convex upper side which, at the point of a linear transition, merges into a concave interlocking surface which is seamlessly transferred into the adjoining stem-like loop end for an interlocking element.

12 Claims, 3 Drawing Sheets

(56) References Cited

U.S. PATENT DOCUMENTS

| | | | | |
|---|---|---|---|---|
| 8,388,880 | B2 * | 3/2013 | Tuma | A44B 18/0065 24/442 |
| 8,745,827 | B2 | 6/2014 | Rocha | |
| 2004/0033336 | A1 | 2/2004 | Schulte | |
| 2008/0289157 | A1 | 11/2008 | Higashinaka et al. | |
| 2010/0095489 | A1 | 4/2010 | Tuma | |
| 2016/0309856 | A1 * | 10/2016 | Poulakis | C09J 175/04 |
| 2020/0277718 | A1 | 9/2020 | Arata et al. | |

FOREIGN PATENT DOCUMENTS

| | | | |
|---|---|---|---|
| DE | 10 2007 003 287 | A1 | 7/2008 |
| EP | 0 211 564 | A2 | 2/1987 |
| GB | 1140576 | A | 1/1969 |
| JP | H0741363 | Y2 * | 9/1995 |
| TW | 201842863 | A | 12/2018 |

* cited by examiner

METHOD FOR PRODUCING A TOUCH-AND-CLOSE FASTENER PART

CROSS-REFERENCE TO RELATED APPLICATIONS

This continuation application claims priority to PCT/EP2022/064913 filed on Jun. 1, 2022 which has published as WO 2022/268465 A1 and also the German application number 10 2021 003 311.6 filed on Jun. 26, 2021, the entire contents of which are fully incorporated herein with these references.

DESCRIPTION

Field of the Invention

The invention relates to a method for producing a touch-and-close fastener part (i.e., an adhesive closure part).

Background of the Invention

DE 102 40 986 B3 discloses a touch-and-close fastener part for a touch-and-close fastener, whereby corresponding closure elements may be brought into releasable engagement with one another, comprising a base structure having a thread system of warp threads and weft threads and at least one functional thread, which partly engages with the base material and which forms the closure elements. Due to the fact that, in order to produce the known touch-and-close fastener part, the corresponding functional thread is cut at the point where a loop is formed to form a closure hook or that, in the event of thermal energy input—provided that the functional thread consists of a plastics material—the separated ends of the closure elements form mushroom-like closure heads, it has been shown that the known closure parts or interlocking elements with associated fastening devices form high-strength system connections with one another, which can be separated from one another at any time if necessary with correspondingly great actuating forces to be applied manually in the sense of a releasable Velcro® touch-and-close fastener. In order to obtain such a connection solution, specially coordinated surfaces and individual components are required, which leads to correspondingly high production costs.

The mushroom-like closure heads produced by means of the thermal energy input process project relatively far at the edge in the radial direction over an associated stem, with which the respective closure head is connected to the base structure in the form of the base material at an axial distance. In this way, high adhesive strength values are expected if a relevant closure head comes into interlocking engagement with another mushroom-like closure head of a further touch-and-close fastener part to form the touch-and-close fastener or with a corresponding loop material of the further closure part. In practice, however, it has been shown that with correspondingly large interlocking heads, increased penetration resistance can occur inadvertently if the head in question penetrates the adjacent head or loop material, for example because head comes to rest on head or the loop material is compressed by the head material required for interlocking without the desired interlocking engagement being achieved.

Proceeding from this prior art, the invention is therefore based on the object of creating a method for producing a touch-and-close fastener part which can be connected to further closure parts to form a touch-and-close fastener, with high shear strengths being achieved. This object is achieved by a method having the features of claim 1 in its entirety.

SUMMARY OF THE INVENTION

The method according to the invention for producing a touch-and-close fastener part is characterized by at least the following steps: producing a base structure from a thread system comprising individual loops which consist at least partially of a polyamide or polyester plastics material; cutting at least a portion of the loops to form two stem-like loop ends; heating the loop ends at a predeterminable temperature and for a predeterminable heating time until a head shape is produced as a thickening at the respective loop end under the surface tension of the plastics material; and forming the head shape with a convex upper side which, at the point of a linear transition, merges into a concave interlocking surface which is seamlessly transferred into the adjoining stem-like loop end for an interlocking element.

Due to the fact that a convex head shape upper side is achieved by means of the method according to the invention, a type of projecting sliding surface is created on which the adjacent head or loop material can slide during engagement processes and then comes into direct contact with the concave interlocking surface for a reliable, releasable connection of two connectable touch-and-close fastener parts of a complete touch-and-close fastener.

It is surprising to one of ordinary skill in the field of touch-and-close fasteners that, at the point of a linear transition on the head part, it can have its convex upper side merge into a concave underside and thereby achieve high shear strengths without the head part having to project radially with a clear projection over the outer circumference of the adjoining stem, as was previously the case in the prior art due to a sharp edge formation.

Although the head part produced by the method according to the invention has relatively small dimensions with convex-concave shaping surfaces, which benefits undisturbed interlocking engagement, in addition to the high shear strengths, sufficiently high interlocking forces and, in particular, corresponding peel strength values are achieved, to which the overall rigid structure of each interlocking element contributes. The polyamide and polyester fibers used in the production process are high-strength and have a high degree of rigidity, so that the required interlocking and peel strength forces can easily be derived via the respective interlocking element into its base structure, even within the scope of a miniaturized design for each interlocking element. Furthermore, the plastics materials used have good abrasion resistance and wear resistance; even after long-term use as part of a complete touch-and-close fastener which can be opened and closed again and again.

In a further preferred embodiment of the method according to the invention, it is provided that the base structure is formed from a: fabric of warp and weft threads into which individual pile threads are woven to form loops; knitted fabric having a thread system in which the individual loops are always connected in sequence; or knitted fabric having a plurality of threads running parallel to one another, which, when pushed into one another, form loops. Ultimately, it is important that the respective base structure has a projecting loop material, after the separation and heating or torching of which, the head parts are created with their desired convex and concave surface shapes.

In a further particularly preferred embodiment of the method according to the invention, it is provided that the corresponding loop is cut through at a height between a lower region and an upper region, starting from the base structure in a straight line and in a predeterminable cutting plane, preferably running parallel to the base structure, for example in a range between 30% and 90%, particularly preferably in a range between 50% and 80% of the associated vertex-height of the loop minus the respective thread diameter. This results in different lengths of stems measured from the base structure up to the beginning of the respective head part, so that very different structures of closure parts can be generated with only one production method.

In a further preferred embodiment of the method according to the invention, it is provided that in the case of the straight-line cut: through a region in which the fiber of a loop has a slight curvature up to the arcuate transition, a symmetrical head shape is formed by subsequent heating; and through a region in which the fiber of the loop is more curved in the direction of the arcuate transition, an asymmetrical head shape is formed by subsequent heating.

While a symmetrical head shape results in comparable interlocking forces and peel strength values in all directions, an asymmetrical head shape allows a preferred direction for closing and opening a touch-and-close fastener to be achieved in the direction of the more curved arch transition.

In a further preferred embodiment of the method according to the invention, it is provided that, in order to obtain a symmetrical head shape, the straight cut is produced as a preform having a loop end in the form of a cylindrical stem and in order to obtain an asymmetrical head shape, a stem having an obliquely inclined head surface that projects from the stem is produced as a preform which, starting from its projection having a concave interlocking surface, merges into the cylindrical stem. In any case, the volume of material stored in the stem is sufficient to create the required head shape, be it as part of a symmetrical or asymmetrical structure.

In a further preferred production method, it is provided that the axial length of the corresponding preform is shortened by heating to form the corresponding head shape in the direction of the relevant final shape. The resulting shortening during the shaping process results in a more uniform and compacted material flow within the stem for each interlocking element, which leads to improved rigidity values.

In order to ensure good penetration into the corresponding closure material of an associated closure part to maintain the complete touch-and-close fastener, with simultaneously good adhesion of the adjacent closure elements coming into engagement with one another, it is provided that the curvature of the convex upper side is equal to or substantially equal to the curvature of the concave interlocking surface for a single head shape.

In a further preferred embodiment of the method according to the invention, it is provided that in the case of the symmetrical head shape in plan view, a circular region is formed by heating and in the case of the asymmetrical head shape in plan view, an elongated region, in particular, in the manner of an ellipse, is formed by heating. While the circular surface as a head shape, which forms the linear transition, opens a uniform possibility of interlocking in all directions, the elliptical shape specifies a preferred direction with improved interlocking for the elliptical parts projecting over the stem.

The invention further relates to a touch-and-close fastener part, in particular, produced by a method as presented above, which it is characterized in that it consists of a plurality of spaced-apart interlocking elements made of a polyamide or polyester plastics material, each of which is provided with a stem and a head part and projects to one side as part of individual, cut loops from a base structure formed from a thread system, and in that the head part has a head shape having a convex upper side, which, at the point of a linear transition, merges into a concave interlocking surface which opens seamlessly into the adjoining stem. With the method according to the invention, such touch-and-close fastener parts can be made available in large quantities in a cost-effective manner. In particular, a relevant touch-and-close fastener part can be used in the field of so-called floor pan textiles, for example for fixing a floor mat provided with corresponding touch-and-close fastener parts in the interior of motor vehicles. The floor mat is thus securely attached to the vehicle floor and can be easily removed from the vehicle floor for cleaning or replacement and, if necessary, reattached there in a non-slip manner.

In a preferred embodiment of the touch-and-close fastener part according to the invention, it is provided that the ratio of the diameter D at the point of the linear transition between the convex head shape and the concave interlocking surface to the diameter d of the stem is $\leq 2.5$, preferably $\leq 2$, particularly preferably $\leq 1.8$. In particular, with such diameter ratios, a good penetrating ability for the touch-and-close fastener part has been achieved while at the same time having a high arresting effect against associated touch-and-close fastener parts of a complete touch-and-close fastener as a result of the inherent rigidity of the interlocking element.

BRIEF DESCRIPTION OF THE DRAWINGS

The method according to the invention for producing a touch-and-close fastener part is explained in more detail below by means of embodiments for such a touch-and-close fastener part. In the drawings, which are schematic representations that are not to scale.

DETAILED DESCRIPTION OF EMBODIMENTS OF THE INVENTION

Figure 1:
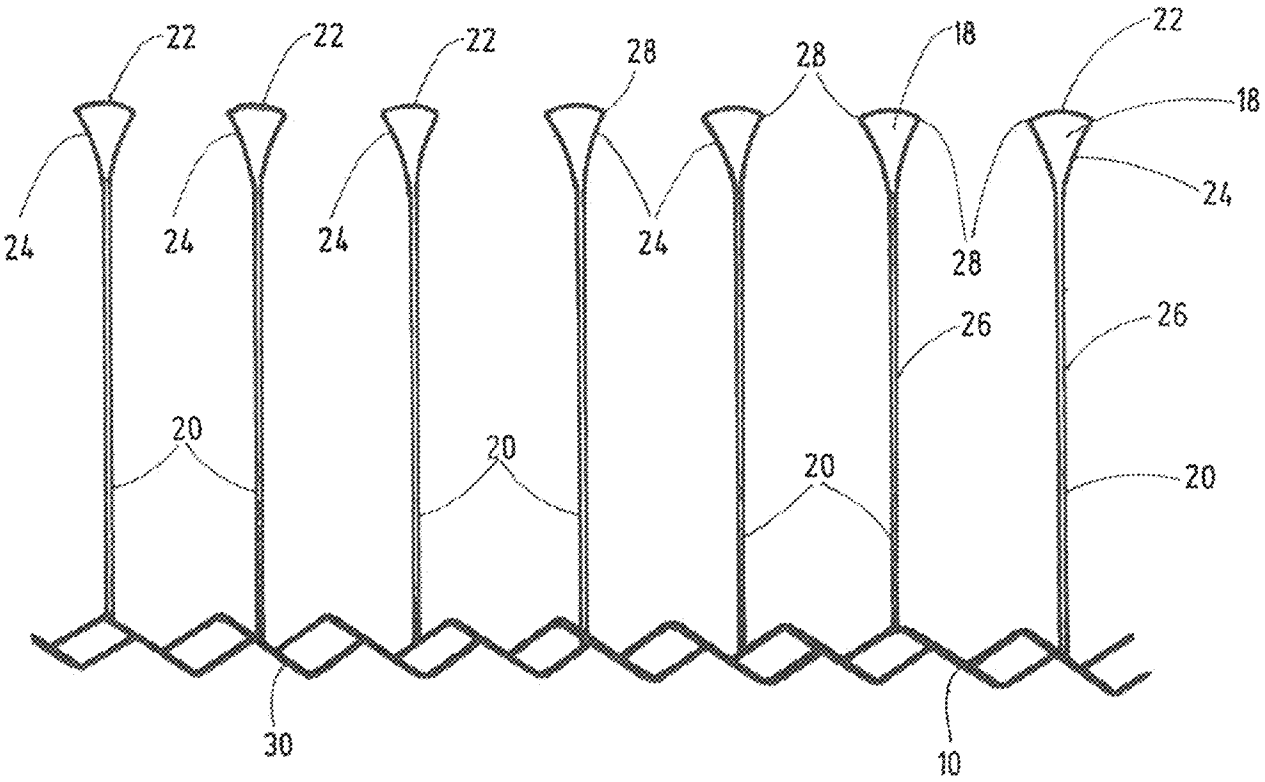
FIG. 1 shows a sectional side view of a touch-and-close fastener part with individual head shapes, as shown in FIG. 4.
Figure 2:
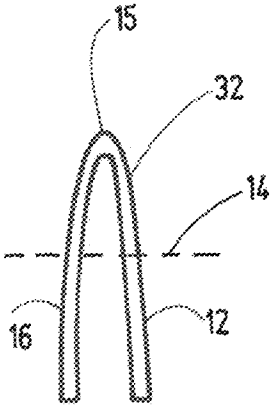
Figures 6, 7, 8, 9:
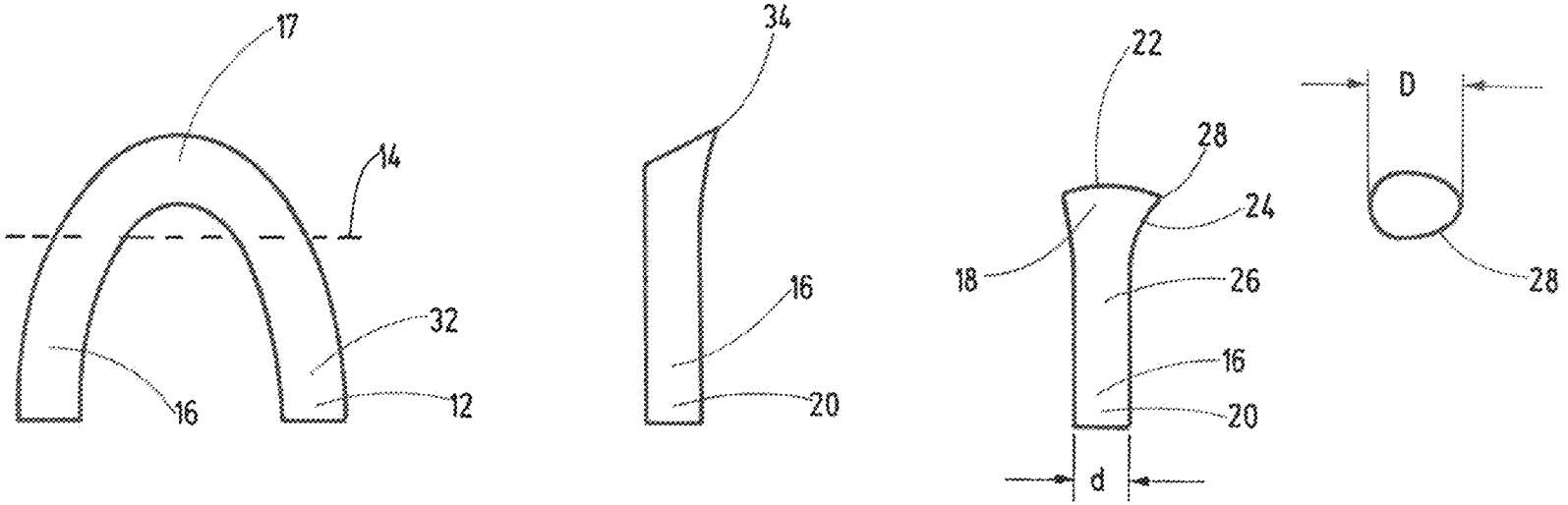
FIGS. 6 to 9 show individual production steps, which are broken down and in turn, to obtain a modified embodiment compared to FIGS. 1 to 5.

FIG. 1 is a section of a touch-and-close fastener part consisting of a base structure 10 formed from a thread system having individual loops 12 as shown by way of example in FIGS. 2 and 6 for a single interlocking element 26. The individual loops 12 consist of a polyamide or polyester plastics material. As shown in FIGS. 2 and 6, these loops 12 are cut along a cutting line 14, which in the given case runs parallel to the base structure 10. However, it is also possible here to select a different cutting plane (not shown) that is inclined on all sides.

Figure 4:
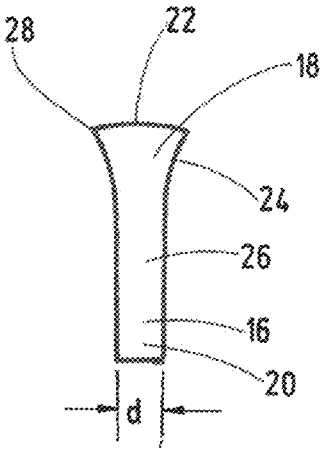
Figure 3:
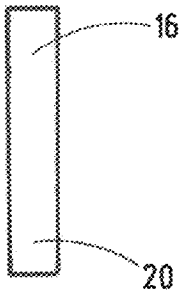

The separated loop ends 16 are heated or torched at a predeterminable temperature and for a predeterminable heating time until a head shape 18 is created as a thickening at the respective loop end 16 under the surface tension of the melted or softened plastics material, as shown in FIGS. 4 and 8. In FIGS. 3 and 7, the left-hand stem part element, seen in the direction of view of FIG. 2 or 6, is shown as the loop end 16. While a straight cylindrical loop end 16 or stem part is substantially created when cutting through the loop structure according to FIG. 2, the thread structure used according to FIG. 6 is thicker in diameter than the thread according to FIG. 2, so that due to the internal tension of the thread material, a loop end structure is created in a raised manner with an inclined plane according to FIG. 7.

Figure 5:
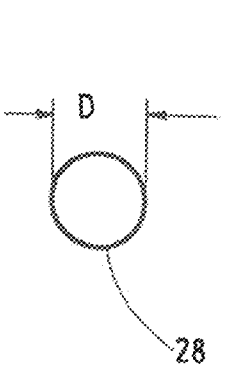
FIGS. 2 to 5 show highly simplified representations of the individual production steps for obtaining a touch-and-close fastener part according to FIG. 1.

The stems 20 in the form of the loop ends 16 shown partially in FIGS. 3 and 7 are then heated from above over the softening temperature of the plastics material, which is not shown in more detail, wherein, in a configuration according to FIG. 3, a head shape 18 or head part according to FIGS. 4 and 5 is established, and at the loop end 16 according to FIG. 7, a head shape 18 or head part according to FIGS. 8 and 9 is created, wherein FIG. 5 is a plan view of the head shape 18 according to FIG. 4, and FIG. 9 is the plan view of the head shape 18 according to FIG. 8 in an elliptical embodiment.

Both head shapes 18 according to FIGS. 4 and 8 have a convex upper side 22 and laterally adjacent, a circumferential concave interlocking surface 24. A linear transition 28 is located between the respective convex upper side 22 and the concave interlocking surface 24 below it, which linear transition is circular as shown in FIG. 5 or is elliptical as shown in FIG. 9 for the interlocking element 26 shown in FIG. 8. All interlocking elements 26 are designed in one piece and the individual head shapes 18 merge seamlessly into the stems 20 or into the loop ends 16.

As can be seen, in particular, from FIG. 1, the base structure 10 is formed from a fabric 30 of warp and weft threads, into which individual pile threads 32 are woven to form the loops 12. Such a fabric structure for a touch-and-close fastener part is shown by way of example in DE 102 40 986 B3 and is known for multi-filament systems from DE 10 2007 003 287 A1. The number of individual interlocking elements 26 on the base structure 10 can be 100 to 200 pieces/cm$^2$ with a corresponding stem diameter d for an interlocking element 26 in the range of 150 to 250 μm. Furthermore, the height of the respective interlocking element 26, calculated from the foot-side base on the base structure 10 to the outermost end of the head part, can be 1200 to 2200 μm and the dimension of the head part diameter D at its widest point can be in the range between 200 to 400 μm. In this respect, very long stems 20, which run perpendicular and parallel to one another as shown in FIG. 1, are provided with an extremely small head part with the corresponding head shape 18.

Instead of the fabric 30 shown in FIG. 1 as a base structure 10, said base structure can also consist of a knitted fabric having a thread system in which the individual loops 12 are always connected in sequence. It is also possible to create a knitted fabric having a plurality of threads running parallel to one another, which then, when pushed into one another, form the loops 12. As such knitted fabrics are common in the field of creating touch-and-close fastener parts, they will not be discussed in more detail at this point.

As can also be seen from FIG. 2, the corresponding loop 12 is cut through at a height between a lower region and an upper region, starting from the corresponding base structure 10, in a straight line and in a predeterminable cutting plane, here preferably running parallel to the base structure 10 along the line 14, for example in a range between 30% and 90%, particularly preferably in a range between 50% and 80% of the associated vertex-height of the loop 12 minus the respective thread diameter for the insert thread used. Thus, the cutting line 14 for the embodiment according to FIG. 2 runs approximately halfway through the loop 12 and in the embodiment according to FIG. 6 approximately in the region of 80% of the stated vertex-height minus the thread diameter.

As is furthermore apparent from FIGS. 3 and 7, in the straight-line cut shown in FIGS. 2 and 6 through a region in which the fiber of a loop 12 has a slight curvature up to the arcuate transition 15, a symmetrical head shape is formed by subsequent heating as shown in FIG. 4 or, in the cut through a region in which the fiber of the loop is more curved in the direction of the arcuate transition 17, an asymmetrical head shape 18 is formed by the aforementioned subsequent heating as shown in FIGS. 8 and 9, with an already asymmetrical intermediate transition position for the loop end 16 as shown in FIG. 7. In order to obtain a symmetrical head shape 18 as shown in FIGS. 4 and 5, the straight cut is produced as a preform having a loop end 16 in the form of a cylindrical stem 20 as shown in FIG. 3, whereas, in order to obtain an asymmetrical head mold according to FIGS. 8 and 9, a stem 20 having an obliquely inclined head surface that projects from the stem 20 is produced as a preform as shown after the intermediate step in FIG. 7, which, starting from its projection 34 having a concave interlocking surface 24, merges into the otherwise cylindrical stem 20 on the foot side.

As is further apparent from the representations according to FIGS. 7 and 8, in the asymmetrical solution, the concave interlocking surface 24 is more pronounced on the right-hand side than on the left-hand side when viewed in the direction of view of the figures. This results in an overall asymmetrical elliptical transition surface between the otherwise cylindrical stem 20 and the linear transition 28 on the head shape 18. As can also be seen from the production step from FIGS. 3 to 4 or FIGS. 7 to 8, the axial length of the respective preform is greater than the later length at which the relevant final shape according to FIGS. 4 and 8 is shortened by heating the stem part end to form the respective head shape 18. It has proven to be particularly advantageous if the curvature of the convex upper side 22 corresponds to the curvature of the concave interlocking surface 24, which in the embodiment according to FIG. 8 corresponds to the most concave interlocking surface 24. It has proven to be particularly advantageous for the touch-and-close fastener part if, as shown in FIGS. 4 and 5 as well as FIGS. 8 and 9, the ratio of the diameter D at the point of the linear transition 28 between the convex head shape 22 and the concave interlocking surface 24 to the diameter d of the stem is $20 \leq 2.5$, preferably $\leq 2$, particularly preferably $\leq 1.8$. This results in a particularly inherently stable, secure interlocking touch-and-close fastener structure, as shown in principle in an example in FIG. 1.

It is understood that all figures, in particular, relating to the outer contour, are reproduced in an idealized manner. Due to the material, irregularities in the form of recesses or projecting points arise on the outer circumference of each head shape 18, in particular, along its linear transition 28. Particularly good results have been achieved if the pure pile yarn of the base fabric 30 having the loops 12 is made from 100% polyester and subjected to the following production parameters:

Production speed: 10-12.4 m/m in;
Shear blade speed: 1200-1410 rpm;
Shear height: 2-2.4 mm;
Flame height: 1.50-1.55 mm.

For identification of the respective touch-and-close fastener product, it can be advantageous to use polyamide, so that the product as a whole appears black, or to use a polyester material, which results in a transparent closure structure. Overall, a touch-and-close fastener part is realized with slim stems 20 having adjacent small head shapes 18, so that the closure part according to the invention can be easily incorporated into other closure materials. The fastening device shown achieves high shear strengths with the connectable floor pan textile, so that undesirable slipping is avoided. The head geometries which are kept small according to the invention lead to sufficient adhesive and peel strength values in order to be able to ensure a sufficiently secure anchoring of the floor mat to the floor pan textile without the head parts destroying the floor pan textile through roughening processes. There is nothing in the prior art that corresponds to this.

What is claimed is:

1. A method for producing a touch-and-close fastener part, comprising at least the following steps:

producing a base structure from a thread system comprising individual loops which consist at least partially of a polyamide or polyester plastics material;

cutting at least a portion of the loops to form two stem-like loop ends;

heating the loop ends at a predetermined temperature and for a predetermined heating time until a head shape is produced as a thickening at the respective loop end under the surface tension of the plastics material; and forming the head shape with a convex upper side which, at the point of a linear transition, merges into a concave interlocking surface which is seamlessly transferred into the adjoining stem-like loop end, the head shape configured to be an interlocking element;

wherein the curvature on the convex upper side substantially corresponds to the curvature of the concave interlocking surface intended for interlocking with a head shape.

2. The method according to claim 1, wherein the base structure is formed from: a fabric of warp and weft threads into which individual pile threads are woven to form the loops; a knitted fabric having a thread system in which the individual loops are always connected in sequence; or a knitted fabric having a plurality of threads running parallel to one another, which, when pushed into one another, form the loops.

3. The method according to claim 1, wherein the respective loop is cut through at a height between a lower region and an upper region, starting from the base structure, in a straight line and in a predetermined cutting plane.

4. The method according to claim 3, wherein in the case of the straight-line cut: through a region in which the fiber of a loop has a slight curvature up to the arcuate transition, a symmetrical head shape is formed by subsequent heating; and through a region in which the fiber of the loop is more curved in the direction of the arcuate transition, an asymmetrical head shape is formed by subsequent heating.

5. The method according to claim 3, wherein in order to obtain a symmetrical head shape, the straight cut is produced as a preform having a loop end in the form of a cylindrical stem and in order to obtain an asymmetrical head shape, a stem having an obliquely inclined head surface that projects from the stem is produced as a preform which, starting from its projection having a concave interlocking surface, merges into the cylindrical stem.

6. The method according to claim 5, wherein the axial length of the respective preform is shortened by heating to form the respective head shape in the direction of the relevant final shape.

7. The method according to claim 1, wherein the respective loop is cut through at a height between a lower region and an upper region, starting from the base structure, in a straight line and in a predetermined cutting plane, running parallel to the base structure, in a range between 30% and 90% of the associated vertex-height of the loop minus the respective thread diameter.

8. The method according to claim 1, wherein the respective loop is cut through at a height between a lower region and an upper region, starting from the base structure, in a straight line and in a predetermined cutting plane, running parallel to the base structure, in a range between 50% and 80% of the associated vertex-height of the loop minus the respective thread diameter.

9. The method according to claim 1, wherein in the case of a symmetrical head shape in plan view, a circular region is formed by heating and in the case of an asymmetrical head shape in plan view, an elongated region in the manner of an ellipse is formed by heating.

10. The method according to claim 1, wherein the concave interlocking surface has no linear transitions when transitioning into the adjoining stem-like loop end.

11. A method for producing a touch-and-close fastener part, comprising at least the following steps:

producing a base structure from a thread system comprising individual loops which consist at least partially of a polyamide or polyester plastics material;

cutting at least a portion of the loops to form two stem-like loop ends;

heating the loop ends at a predetermined temperature and for a predetermined heating time until a head shape is produced as a thickening at the respective loop end under the surface tension of the plastics material; and forming the head shape with a convex upper side which, at the point of a linear transition, merges into a concave interlocking surface which is seamlessly transferred into the adjoining stem-like loop end, the head shape configured to be an interlocking element;

wherein the concave interlocking surface has no linear transitions when transitioning into the adjoining stem-like loop end.

12. A method for producing a touch-and-close fastener part, comprising at least the following steps:

producing a base structure from a thread system comprising individual loops which consist at least partially of a polyamide or polyester plastics material;

cutting at least a portion of the loops to form two stem-like loop ends;

heating the loop ends at a predetermined temperature and for a predetermined heating time until a head shape is produced as a thickening at the respective loop end under the surface tension of the plastics material; and forming the head shape with a convex upper side which, at the point of a linear transition, merges into a concave interlocking surface which is seamlessly transferred into the adjoining stem-like loop end, the head shape configured to be an interlocking element;

wherein the curvature on the convex upper side substantially corresponds to the curvature of the concave interlocking surface intended for interlocking with a head shape formed with the same curvature.

* * * * *